US006003248A

United States Patent [19]

Hilgarth

[11] Patent Number: 6,003,248

[45] **Date of Patent: *Dec. 21, 1999**

[54] HEATABLE LINER FOR FOOTWEAR

[75] Inventor: Kurt Hilgarth, Graz-Seiersberg, Austria

[73] Assignee: Fancyform Design Engineering, Graz-Grambach, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/907,612

[22] Filed: Aug. 8, 1997

[30] Foreign Application Priority Data

Aug. 9, 1996 [AT] Austria ..... 468/96 U

[51] Int. Cl.[6] ..... A43B 23/07; A43B 7/02

[52] U.S. Cl. ..... 36/55; 36/2.6

[58] Field of Search ..... 36/2.6, 93, 55, 36/88

[56] References Cited

U.S. PATENT DOCUMENTS

| | | | |
|---|---|---|---|
| 2,298,299 | 10/1942 | Joy et al. | 219/46 |
| 3,641,688 | 2/1972 | von den Benken | 36/43 |
| 3,906,185 | 9/1975 | Gross et al. | 36/2.6 X |
| 4,433,494 | 2/1984 | Courvoisisier et al. | 36/93 X |
| 4,507,877 | 4/1985 | Vaccari et al. | 36/2.6 |
| 4,665,308 | 5/1987 | Courvoisier et al. | 36/2.6 X |
| 4,782,602 | 11/1988 | Lakic | 36/2.6 |
| 5,063,690 | 11/1991 | Slenker | 36/2.6 |
| 5,829,171 | 11/1998 | Weber et al. | 36/93 |

FOREIGN PATENT DOCUMENTS

| | | | |
|---|---|---|---|
| 0 084 789 | 8/1983 | European Pat. Off. . | |
| 2553029 | 4/1985 | France . | |
| 25 49 375 | 5/1976 | Germany . | |
| 1228384 | 4/1971 | United Kingdom | 36/2.6 |
| WO98/14082 | 4/1998 | WIPO . | |

*Primary Examiner*—B. Dayoan

*Attorney, Agent, or Firm*—Jacobson, Price, Holman & Stern, PLLC

[57] ABSTRACT

A liner is disclosed for footwear, in particular for ski boots, climbing boots or the like, with a thermoplastic and a heating arrangement, and a process for adapting such a liner to the shape of the foot of the person using such a liner. In order to achieve optimum adaptation in a simple manner, it is provided that the electric heating arrangement is formed by at least one heatable film 1 which is arranged in the liner and with the aid of which the thermoplastic of the liner can be heated so that it can be adapted to the shape of the foot of the person using the liner. The or each heatable film 1 preferably comprises a flexible plastic layer on which there is arranged at least one resistance layer 2, of which the ends 7, 8 are connected to at least one connecting lead 3, which is routed outward, and at least one plug 4. To make allowances for sensitive points of the foot, it is possible for cutouts to be provided in the resistance layer 2, if need be covered by an aluminum foil 5, or for incisions 6, perforations or the like to be provided in the film 1.

5 Claims, 4 Drawing Sheets

HEATABLE LINER FOR FOOTWEAR

Figure 1:
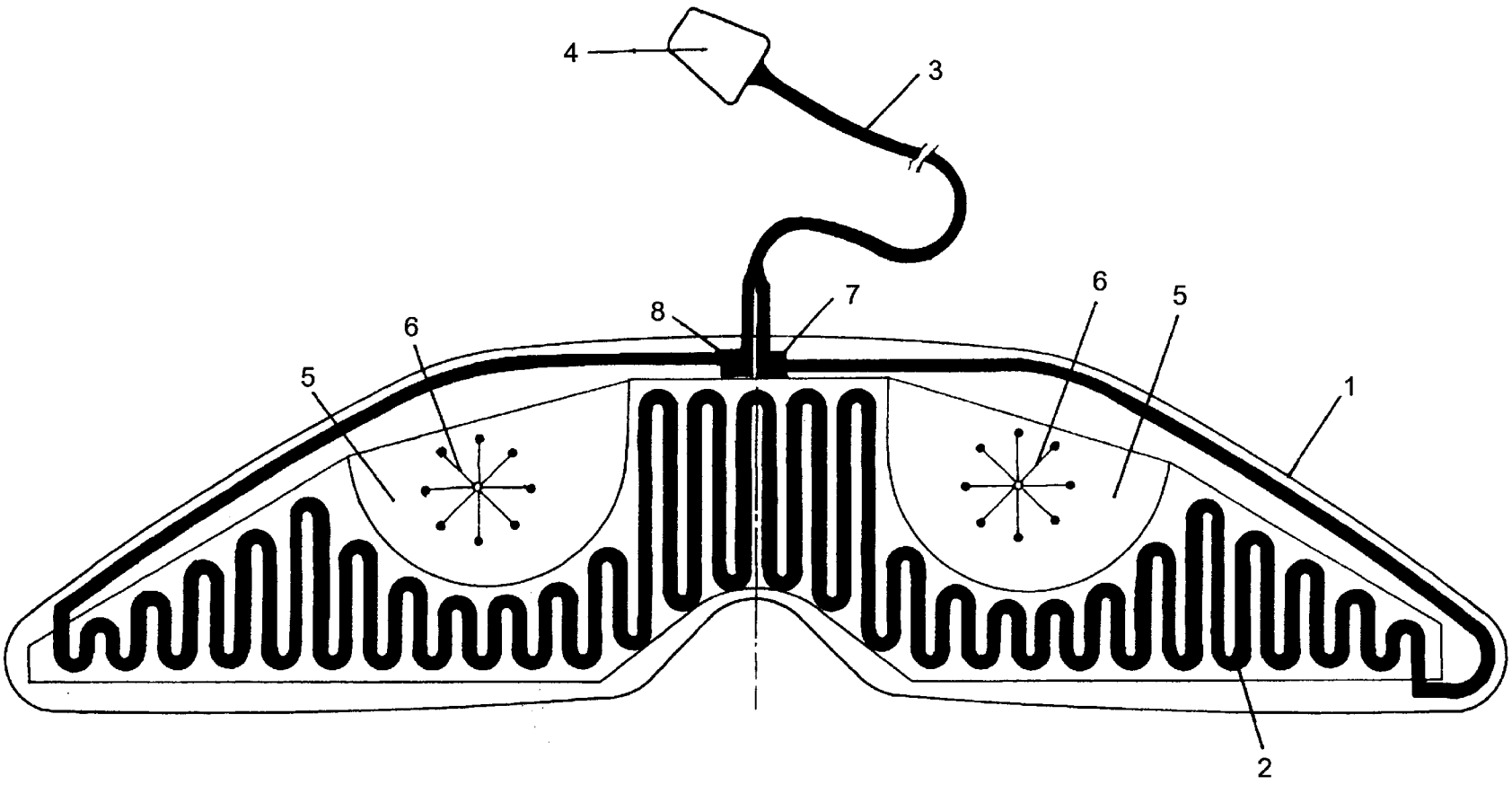

The invention relates to a liner for footwear, in particular for ski boots, climbing boots or the like, with a thermoplastic and an electric heating arrangement, and to a process for adapting such a liner to the shape of the foot of the person using such a liner.

Liners for footwear, in particular for ski boots, which can be deformed, using heat, so that they can be adapted to the shape of the foot, in order to avoid pressure points, have been known for some time now. For this purpose, the liners consist of a special plastic material which, at a certain temperature, lends itself well to deformation. This temperature is considerably higher than the temperatures which are present in the boot or shoe when the latter is worn, with the result that subsequent deformation is prevented and the liner provides the foot with corresponding support. It is normally the case that, for the purpose of adaptation to the shape of the foot, the liner is first of all removed from the shell of the boot or shoe, heated beyond the temperature which is necessary for easy deformation, and then reinserted into the shell of the boot or shoe. The wearer of the boot or shoe puts the latter on while it is in the heated state, and the liner is adapted to the shape of the foot. In this case, the operation of adapting the liner to the shape of the foot is very laborious since first of all the liner has to be removed from the shell, then it has to be heated, for example, in an oven or the like and, after this, it has to be reinserted into the shell of the boot or shoe before adaptation of the liner to the shape of the foot can take place. If the time taken for inserting the liner into the shell of the boot or shoe is too long, this may even result in the temperature of the liner dropping below the temperature which is necessary for optimum deformation, in which case adequate adaptation to the shape of the foot thus cannot take place.

FR 2 553 029 A1 discloses an article which can be deformed under the action of heat and comprises an electric resistance-heating arrangement over which a foam made of polyolefin, in particular polyethylene, is heated and can thus be deformed under pressure. A sole for sports footwear may be mentioned here by way of example. Examples of electric heating arrangements in boots or shoes which are only used for the purpose of heating the foot are given in U.S. Pat. No. 4,782,602, EP 084 789 A1, DE 25 49 375 A1 or U.S. Pat. No. 2,298,299. Liners which make it possible for the boot or shoe to be adapted to the shape of the foot of the person wearing said boot or shoe are not known.

The object of the present invention is thus to provide a liner, in particular for a ski boot, climbing boot or the like, with which simple adaptation to the shape of the foot of the person wearing the footwear in question is possible. It is intended to avoid, or at least to reduce, the abovementioned disadvantages of known systems.

In order to achieve this object, the liner according to the invention is defined in that the electric heating arrangement is formed by at least one heatable film which is arranged in the liner and with the aid of which the thermoplastic of the liner can be heated so that it can be adapted to the shape of the foot of the person using the liner. The liner equipped, according to the invention, with one or more heatable films need not be removed from the shell for the purpose of adaptation to the shape of the foot, this vastly reducing the amount of work involved. Since appropriate arrangement of the heatable film makes it possible for the heat to be directed specifically onto the thermoplastic, the temperature which is necessary for deformation is reached very quickly, as a result of which the time which is necessary for adapting the liner to the shape of the foot of the person using the liner is likewise reduced considerably. By virtue of a suitable configuration and arrangement of the or each heatable film in the liner, it is possible to achieve optimum adaptation to the respective application.

The or each heatable film advantageously comprises a flexible plastic layer on which there is arranged at least one resistance layer, of which the ends are connected to at least one connecting lead, which is routed outward. In this way, the heatable film according to the invention can be produced inexpensively, similarly to flexible printed circuits, and subsequently bent in accordance with the shape of the liner or foot. The arrangement of a plurality of resistance zones permits selective heating of the thermoplastic in the liner. It is possible for the resistance layer to comprise any electrically conductive materials. Woven fabrics comprising, for example, carbon fibers are also conceivable.

If the or each connecting lead terminates in a plug, the boot or shoe can be easily and reliably connected to a corresponding voltage source for supplying the or each heatable film with electrical energy.

According to a further feature of the invention, the or each resistance layer is arranged in meandering fashion. Such an arrangement provides for optimum use of space and, furthermore, can be easily produced.

According to a development of the invention, the or each resistance layer of the or each heatable film is cut away at sensitive points of the foot, for example in the region of the ankle or of the heel. This prevents said regions of the foot from being exposed to excessive amounts of heat. Special allowances are thus made for sensitive points of the foot.

In addition, it may be provided that an aluminum foil or the like is arranged at the sensitive points of the foot at which the or each resistance layer of the or each heatable film is cut away. This measure provides even greater protection against heat for sensitive regions of the foot since the heat can be dissipated more easily over the metal surface area.

If the or each heatable film has incisions, perforations or the like at sensitive points of the foot, for example in the region of the ankle or of the heel, higher flexibility of the film is provided, as a result of which it is possible to achieve a higher degree of comfort for the user of the liner and better adaptability of the liner to the shape of the foot.

Of course, it is also possible for the or each heatable film itself to be cut away at sensitive points of the foot, for example in the region of the ankle or of the heel. The abovementioned advantages are likewise achieved thereby. Furthermore, an appropriate configuration makes it easier to arrange the film in the liner. Instead of cutouts, it is, of course, also possible to provide a plurality of films, which can be connected to one another electrically via corresponding leads.

If at least one temperature-measuring sensor is provided in the or each heatable film or in the liner, it is possible for the signal emitted by the sensor, or for the signals emitted by the sensors, to be used in order to regulate the temperature. Measuring the temperature in the interior of the boot or shoe means that, on the one hand, it is possible to prevent a certain upper temperature limit from being exceeded and, on the other hand, it is possible to ensure that the temperature which is necessary for optimum deformability of the thermoplastic of the liner is reached.

A further object of the invention is to provide a process for adapting a liner of the abovedescribed type to the shape of the foot of the person using such a liner.

This object is achieved by the following process steps:

inserting the foot into the liner, connecting the or each heatable film of the liner to an electric voltage source, disconnecting the or each heatable film of the liner from the electric voltage source once the temperature which is necessary for good deformability of the thermoplastic of the liner has been reached, leaving the foot in the liner until the temperature has fallen below the temperature which is necessary in order to render the thermoplastic of the liner deformable, and repeating steps b to d if required.

This constitutes a simple process variant for adapting a liner to the shape of the foot.

As an alternative to this, the object may also be achieved by the following process steps, in chronological sequence:

connecting the or each heatable film of the liner to an electric voltage source, disconnecting the or each heatable film of the liner from the electric voltage source once the temperature which is necessary for good deformability of the thermoplastic of the liner has been reached, inserting the foot into the liner, leaving the foot in the liner until the temperature has fallen below the temperature which is necessary in order to render the thermoplastic of the liner deformable, and repeating steps a to d if required.

This variant has the advantage that the person puts on the boot or shoe while his/her foot is at its normal temperature, as a result of which this is in its normal state. In contrast, in the case of the previously mentioned process, the foot can expand as a result of excessive heating, so that optimum adaptation to the shape of the foot is not possible. In addition, the excessive heating may feel uncomfortable.

Advantageously, in the case of the process according to the invention, the temperature in the liner is measured, and the or each heatable film of the liner is automatically disconnected from the electric voltage source once the temperature which is necessary for good deformability of the thermoplastic of the liner has been reached. This protects the foot and the liner against overheating and, in addition, ensures that the temperature which is necessary for good deformability of the thermoplastic of the liner is reached.

As an alternative to this, it is possible to determine the amount of time which is required for heating the thermoplastic of the liner to the temperature which is necessary for good deformability, and to effect automatic disconnection of the or each heatable film of the liner from the electric voltage source after a predetermined period of time. This constitutes a simpler and less expensive alternative, albeit one which is not as reliable and accurate, to the use of temperature sensors.

The appropriate process features can easily be incorporated in an appropriate unit for supplying power to the or each heatable film of the liner.

Figure 2A:
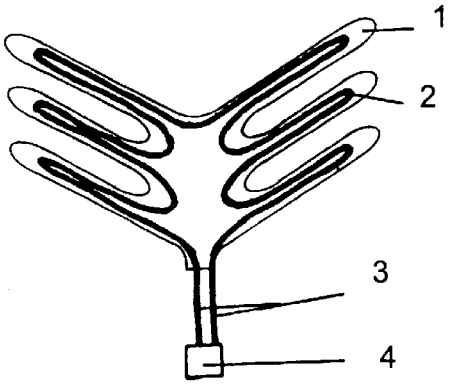
Figure 2B:
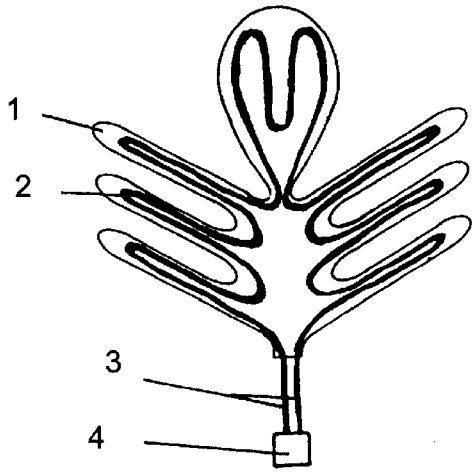
Figure 2C:
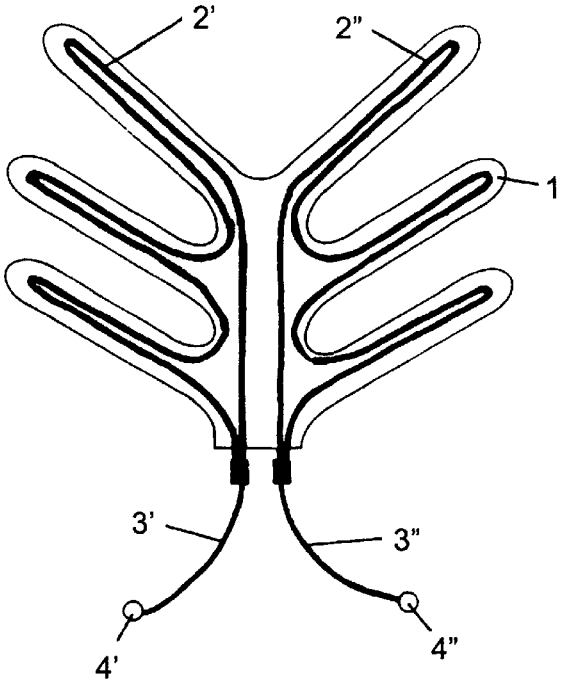
Figure 2D:
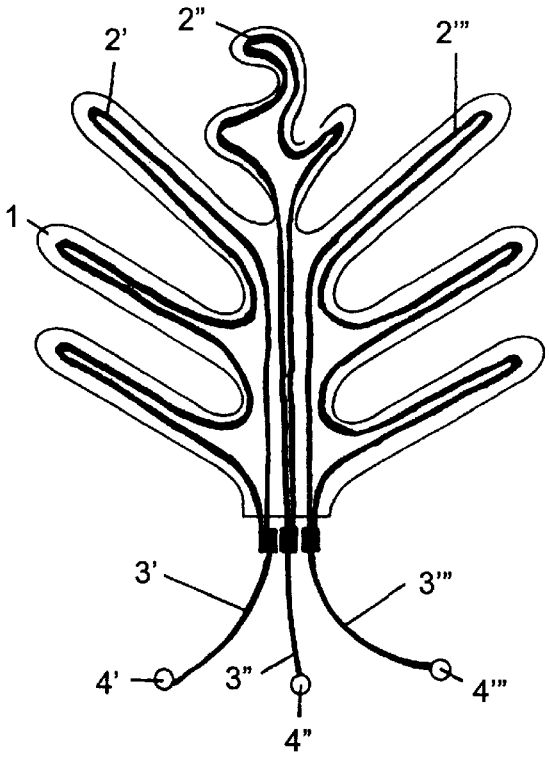
Figure 3A:
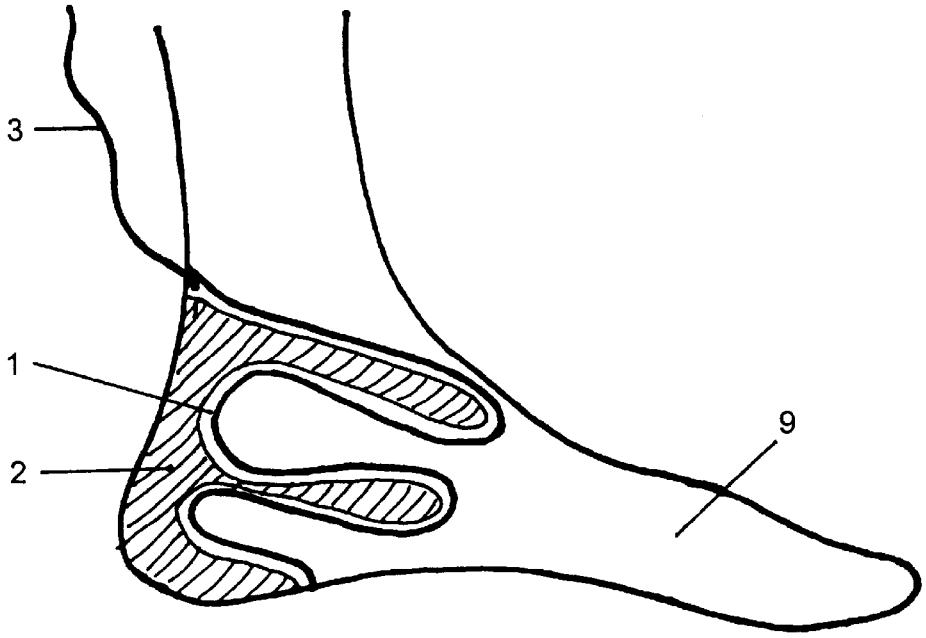
Figure 3B:
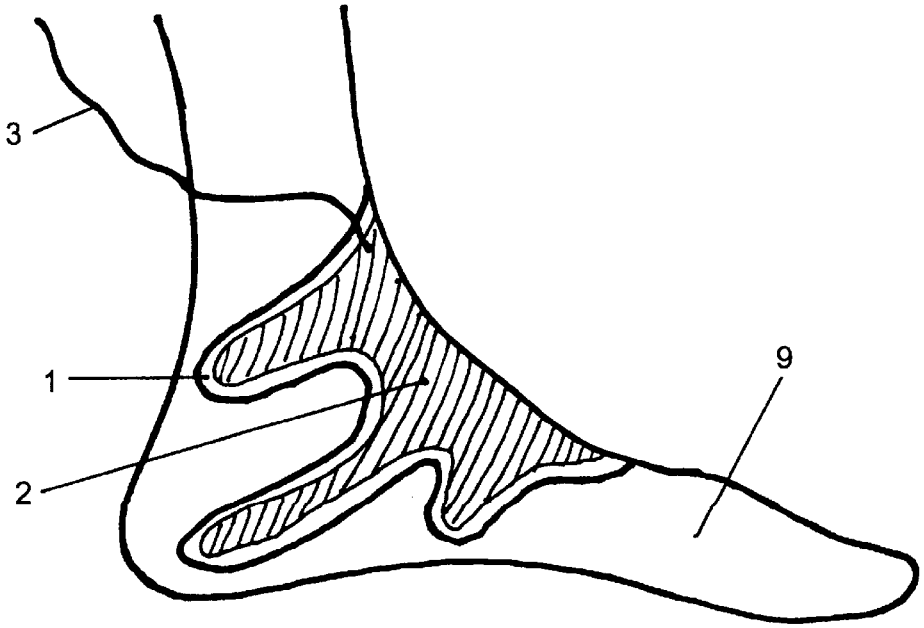
Figure 4A:
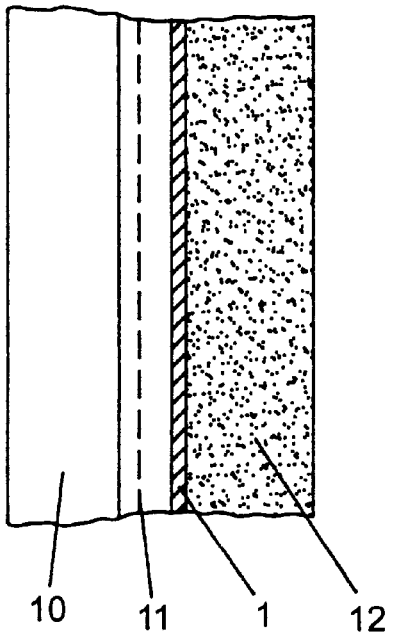
Figure 4B:
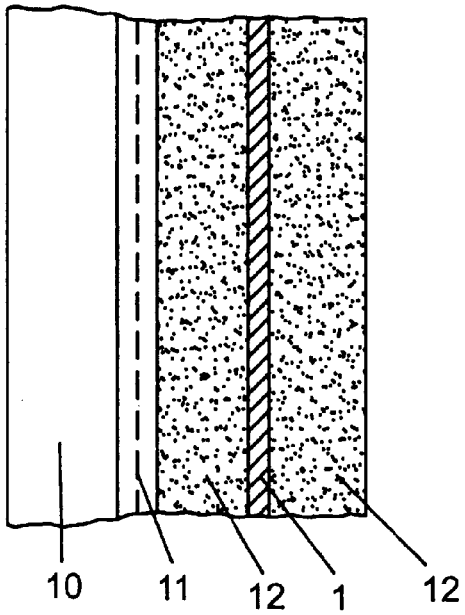
Figure 4C:
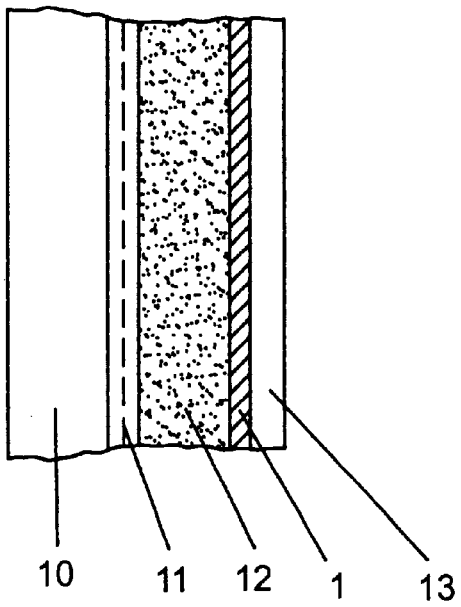

The invention will be explained in more detail with reference to the attached drawings, which show exemplary embodiments of the heating film according to the invention and of the arrangement of the latter in the liner, and in which:

FIG. 1 shows an embodiment of a heatable film according to the invention for a liner in the opened-out state, FIGS. 2*a* to 2*d* show schematic views of design variants of the heatable film for a liner, in planar form, FIGS. 3*a* and 3*b* show two examples of the positioning of a heatable film according to the invention in relation to the foot, and FIGS. 4*a* to 4*c* show examples of the cross-sectional composition of a liner in order to illustrate the positioning of the heatable film in the liner.

FIG. 1 shows an example of a heatable film 1 in the opened-out state. In the liner, the lateral tapering ends of the film 1 are folded together in the direction of the toes of the foot. In order to make a clearance for the heel, the film is cut away in the bottom, central region. The film 1 consists of a-flexible plastic material on which a resistance covering 2 is provided, preferably in meandering fashion. Of course, other designs of the electric resistance-heating arrangement are also possible. For example, it would also be possible for the resistance material to be arranged on or in the film 1 in the manner of a woven fabric made, for example, of carbon fibers (not illustrated). The ends 7, 8 of the resistance covering 2 are connected to a connecting lead 3, via which the heatable film 1 can be supplied with electrical energy. For this purpose, a plug 4 is advantageously provided on the connecting lead 3. The resulting current flow in the resistance layer 2 brings about heat loss, and the film 1, or the liner provided with the film 1, is thus heated uniformly. In the case of conventional thermoplastics, good deformability is achieved with temperatures above 70° C. In order to achieve optimum deformability, the material of the liner is heated to approximately 110° C. This can be controlled by setting the time for which the heatable film 1 is connected to the voltage source or by measuring the temperature by means of a temperature sensor (not illustrated) arranged on the film 1 or in the liner. Once the temperature which is necessary for the deformation of the plastic material has been reached, the heatable film is disconnected automatically or manually from the voltage supply. The liner can be deformed at this temperature and is thus adapted to the shape of the foot. The foot remains in the boot or shoe until the liner has cooled and cannot be deformed any further. This means that the liner has been adapted optimally to the shape of the foot. The precondition for this is that the film 1 which exhibits the resistance covering 2 can be easily deformed. Otherwise, there would be irregular temperature distributions in the material of the liner, as a result of which the liner would be deformable to different extents and optimum adaptation to the shape of the foot would not be possible. For this purpose, according to this exemplary embodiment, the film 1 contains incisions 6, perforations or the like at sensitive points of the foot, for example in the region of the ankle or of the heel, these incisions, perforations or the like permitting easier deformation of the film. In order to protect these sensitive regions of the foot against overheating by the heated film 1, it is possible for an aluminum foil 5 or the like to be arranged at these points for the purpose of dissipating heat. Of course, it is also possible for the film 1 to be cut away fully at the sensitive points of the foot.

FIGS. 2*a* to 2*d* show further design variants of heatable films for use in a liner, in planar form. FIG. 2*a* shows a film 1, with the resistance covering 2 arranged thereon, with three finger-shaped extensions on both sides. The resistance covering 2 is only shown schematically in the drawings and may also be arranged on the film 1 in meandering fashion or in the form of a woven fabric. The resistance covering 2 is connected to the plug 4 via a connecting lead 3. The finger-shaped extensions are folded around the foot from the heel or are folded over the front of the foot from above (see FIG. 3*a* and FIG. 3*b*). Sensitive points of the foot, for example ankles, are not enclosed by the film 1. The configuration according to FIG. 2*a* is characterized by its flexibility when arranged on the foot and by the fact that it is easily deformable. FIG. 2*b* shows a design variant which expands on the film 1 from FIG. 2*a* and in which the film 1 is additionally provided with a centrally arranged extension, which serves for heating the liner in the region of the front of the sole of the foot. FIG. 2*c* shows a variant of the heatable film 1 for a liner in which, in contrast to FIG. 2*a,* two resistance coverings 2' and 2" are provided for the two sides of the film 1. The resistance coverings 2' and 2" terminate in different connecting leads 3' and 3" and plugs 4' and 4". This permits selective heating of the liner for selective adaptation of the liner to the shape of the foot. If the person wearing the boot or shoe feels that adaptation to the shape of the outside of the foot is optimum, while adaptation to the inside of the foot is not yet ideal, it is only that part of the film which encloses the inside of the foot which needs to be reheated in order also to achieve optimum adaptation in that area. The number and configuration of the resistance zones can be selected as desired and in accordance with the respective application. FIG. 2*d* illustrates an example of a heatable film 1 with three resistance coverings 2', 2" and 2'" with three connecting leads 3', 3" and 3'" and three plugs 4', 4" and 4'". In this case, the resistance covering 2" in the central region of the film serves for heating the liner on the sole of the foot in the region of the toes. Of course, rather than providing the individual connecting leads 3', 3" and 3'" and the individual plugs 4', 4" and 4'", it is also possible to provide just one correspondingly multi-stranded connecting lead and one correspondingly multi-poled plug.

FIGS. 3*a* and 3*b* illustrate two examples of the positioning of a heatable film according to the invention in relation to the foot. Depending on the configuration of the film 1 with the resistance covering 2 and the connecting lead 3, said film can be folded over the foot 9 from the heel region, as can be seen from FIG. 3*a*. It is likewise possible to have an arrangement according to FIG. 3*b,* in which the foot 9 is provided with the film 1 from above. An important factor is that the film 1 does not cover sensitive parts of the foot or that the film 1 has appropriate incisions, perforations or the like at such points. Different arrangements of the film 1 in the liner in relation to the foot are also possible depending on the particular application. For example, the problem zones of the foot also depend on the type of sport and will obviously differ, for example, between skiing and climbing.

FIGS. 4*a* to 4*c* show further examples of the arrangement of the heatable film 1 in a liner. FIG. 4*a* shows the cross-sectional layer composition of a liner, for example for a ski boot. The outer layer 10 of the liner is followed by an insulating layer 11, which serves for preventing an excessive amount of heat from escaping to the outside from the heatable film 1. The heatable film 1 is arranged between the insulating layer 11 and a layer of the thermoplastic 12 and allows said thermoplastic to be heated to the temperature which is suitable for deformation. According to FIG. 4*b,* a further layer of thermoplastic 12 is arranged between the insulating layer 11 and the heatable film 1. Suitable selection of the material and of the layer thickness of the thermoplastic 12 makes it possible to optimize the liner as regards adaptability to the shape of the foot of the person using the liner. FIG. 4*c* shows a variant of a layer composition of a liner in which the insulating layer 11 is followed by a layer of the thermoplastic 12, which is followed in turn by the heatable film 1 and, finally, by a lining 13 for the inner surface of the liner.

The configuration of the film and the arrangement of the latter in the liner is not restricted to the examples illustrated, but rather can be changed as desired within the scope of the invention. Of course, it is also possible for the film in the liner to comprise a number of parts.

I claim:

1. A liner for footwear comprising at least one thermoplastic layer (12) and an electric heating arrangement, wherein the electric heating arrangement is formed by at least one heatable film (1) which is arranged in the liner adjacent the at least one thermoplastic layer and which can be used to heat the at least one thermoplastic layer of the liner to a temperature so that it can be deformed to the shape of the foot of the person using the liner, the at least one heatable film having a plurality of finger-shaped extensions on both sides of a central region adapted to be folded around a foot from the heel or folded over the front of a foot from above so that sensitive points of the foot are not enclosed by the at least one heatable film.

2. The liner as claimed in claim 1, wherein the at least one heatable film has a centrally arranged extension for heating the liner in the region of the front of the sole of the foot.

3. The liner as claimed in claim 1, wherein the electric heating arrangement comprises two resistance coverings (2' and 2") one for each side of the at least one heatable film for selective heating of the liner.

4. The liner as claimed in claim 3, wherein the electric heating arrangement comprises three resistance coverings (2', 2" and 2'") with one of the resistance coverings (2") located in the central region of the at least one heatable film for heating the liner on the sole of the foot in the region of the toes.

5. The liner as claimed in claim 1, wherein the at least one heatable film has three finger-shaped extensions on both sides of the central region.

* * * * *